US010711220B2

(12) United States Patent
Komatsubara et al.

(10) Patent No.: US 10,711,220 B2
(45) Date of Patent: Jul. 14, 2020

(54) HIGH TEMPERATURE HEAT-RESISTANT OIL-BASED RELEASE AGENT, HIGH TEMPERATURE HEAT-RESISTANT ELECTROSTATIC APPLICATION-TYPE OIL-BASED RELEASE AGENT, AND APPLICATION METHOD THEREFOR

(71) Applicants: AOKI SCIENCE INSTITUTE CO., LTD., Tokyo (JP); TOYOTA JIDOSHA KABUSHIKI KAISHA, Aichi (JP); MEC INTERNATIONAL CO., LTD., Aichi (JP)

(72) Inventors: Hiroaki Komatsubara, Saitama (JP); Masanao Kobayashi, Saitama (JP); Toshiaki Shimizu, Saitama (JP); Ikuo Yamauchi, Aichi (JP); Takashi Morikawa, Aichi (JP); Eiji Tabata, Aichi (JP); Fumio Kawahara, Aichi (JP); Yuzo Matsuda, Aichi (JP)

(73) Assignees: AOKI SCIENCE INSTITUTE CO., LTD., Tokyo (JP); TOYOTA JIDOSHA KABUSHIKI KAISHA, Aichi (JP); MEC INTERNATIONAL CO., LTD., Aichi (JP)

( * ) Notice: Subject to any disclaimer, the term of this patent is extended or adjusted under 35 U.S.C. 154(b) by 0 days.

(21) Appl. No.: 15/124,752

(22) PCT Filed: Jan. 30, 2015

(86) PCT No.: PCT/JP2015/052606

§ 371 (c)(1),
(2) Date: Sep. 9, 2016

(87) PCT Pub. No.: WO2015/137002

PCT Pub. Date: Sep. 17, 2015

(65) Prior Publication Data

US 2017/0015934 A1 Jan. 19, 2017

(30) Foreign Application Priority Data

Mar. 12, 2014 (JP) ..... 2014-048808

(51) Int. Cl.
*C10M 169/04* (2006.01)
*B05D 1/04* (2006.01)
(Continued)

(52) U.S. Cl.
CPC ..... *C10M 169/041* (2013.01); *B05D 1/04* (2013.01); *B05D 7/14* (2013.01); *B22C 3/00* (2013.01);
(Continued)

(58) Field of Classification Search
CPC .. B05D 1/04; B05D 7/14; B22C 23/02; B22C 3/00; B22D 17/2007; C10M 169/041;
(Continued)

(56) References Cited

U.S. PATENT DOCUMENTS 4,059,534 A * 11/1977 Morro ..... C10M 1/08 252/78.3
2007/0131140 A1 6/2007 Aoki et al.
(Continued)

FOREIGN PATENT DOCUMENTS

CN 1594457 A 3/2005
JP 6-182519 A 7/1994
(Continued)

OTHER PUBLICATIONS

International Search Report issued in Patent Application No. PCT/JP2015/052606, dated Apr. 28, 2015, along with an English translation thereof.
(Continued)

*Primary Examiner* — Alexander M Weddle
(74) *Attorney, Agent, or Firm* — Greenblum & Bernstein, P.L.C.

(57) ABSTRACT

An oil-based release agent of the present invention contains a petroleum-based hydrocarbon solvent (a) and a high temperature adhesive (b), is applied to a metal die used for die casting or casting, has high adhesion and high lubricity even with respect to a metal die at a high temperature particularly of 300° C. or higher, and can prevent seizure. In addition, the present invention provides a method for applying the oil-based release agent of the present invention by controlling an adhesion amount thereof by micronization and speed-control thereof with respect to a metal die at a high temperature, and an electrostatic application method.

7 Claims, 2 Drawing Sheets

(51) Int. Cl.

| | |
|---|---|
| ***B22C 3/00*** | (2006.01) |
| ***B22C 23/02*** | (2006.01) |
| ***B22D 17/20*** | (2006.01) |
| ***B05D 7/14*** | (2006.01) |

(52) U.S. Cl.

CPC ..... *B22C 23/02* (2013.01); *B22D 17/2007* (2013.01); *C10M 2203/1006* (2013.01); *C10M 2207/40* (2013.01); *C10M 2229/041* (2013.01); *C10N 2240/402* (2013.01); *C10N 2250/04* (2013.01)

(58) Field of Classification Search

CPC ..... C10M 2203/1006; C10M 2207/40; C10M 2229/041; C10N 2240/402; C10N 2250/04

See application file for complete search history.

(56) References Cited

U.S. PATENT DOCUMENTS

| | | | | |
|---|---|---|---|---|
| 2009/0074981 | A1 | 3/2009 | Ohira et al. | |
| 2011/0250363 | A1* | 10/2011 | Komatsubara ..... | B22D 17/2007 427/475 |
| 2012/0208939 | A1 | 8/2012 | Aoki et al. | |
| 2015/0057401 | A1 | 2/2015 | Suzuki et al. | |

FOREIGN PATENT DOCUMENTS

| | | | |
|---|---|---|---|
| JP | 7-62380 | A | 3/1995 |
| JP | 9-235496 | A | 9/1997 |
| JP | 2007-326145 | A | 12/2007 |
| JP | 2008-19299 | A | 1/2008 |
| JP | 4095102 | B2 | 3/2008 |
| JP | 2008-93722 | A | 4/2008 |
| JP | 2010-77321 | A | 4/2010 |
| JP | 2011-56518 | A | 3/2011 |
| JP | 4764927 | B2 | 6/2011 |
| JP | 2011-161464 | A | 8/2011 |
| JP | 2012-115841 | A | 6/2012 |
| JP | 4953117 | B2 | 3/2013 |
| JP | 2013-173183 | A | 9/2013 |
| WO | 2008/123031 | A1 | 10/2008 |
| WO | 2013/111708 | A1 | 8/2013 |

OTHER PUBLICATIONS

Written Opinion of the International Search Authority issued in Patent Application No. PCT/JP2015/052606, dated Apr. 28, 2015.

Office Action issued in Japanese Counterpart Application No. 2014-048808, dated Mar. 1, 2016, along with an English translation thereof.

Chinese Office Action issued in Counterpart Patent Appl. No. 201580013230.4, dated Jun. 21, 2017, with an English translation thereof.

* cited by examiner

HIGH TEMPERATURE HEAT-RESISTANT OIL-BASED RELEASE AGENT, HIGH TEMPERATURE HEAT-RESISTANT ELECTROSTATIC APPLICATION-TYPE OIL-BASED RELEASE AGENT, AND APPLICATION METHOD THEREFOR

TECHNICAL FIELD

The present invention relates to an oil-based release agent (also referred to as lubricant) used for casting or die casting of aluminum, magnesium, zinc, or a non-ferrous metal such as an alloy containing these elements, and a method for applying the oil-based release agent.

BACKGROUND ART

As is well known, casting is a metal processing method for pouring a metal which has become liquid by being heated at a high temperature (hereinafter, referred to as molten metal) into a die and extracting the cold solidified metal (hereinafter, referred to as work). Casting is classified into sand die casting, metal die casting, and the like according to a die. The metal die casting is further classified into die casting, low pressure casting, gravity casting, and the like according to a magnitude of pressure at which molten metal is injected and an injection speed thereof. Die casting is a metal processing method for injecting molten metal into a metal die formed of a special steel material at a high pressure and a high speed, cooling the molten metal rapidly, and extracting the solidified work.

In die casting, mechanization advances, and productivity is high. Therefore, die casting is widely used in automobile parts, machine parts, and the like.

In a state where there is no release agent, seizure or galling occurs between a work and a metal die. In order to prevent this seizure or the like, prior to injection of molten metal, a release agent or the like is applied to a metal die. A water-soluble release agent having little risk of fire or the like is generally used for this release agent.

In die casting, in order to improve a production efficiency, reduction in cycle time is desired. This reduction in cycle time reduces time for cooling a metal die, and therefore a metal die temperature is rising. Therefore, a release agent having high temperature heat resistance is desired.

In a conventional water-soluble release agent, adhesion of a metal die at a high temperature is not sufficient, and seizure or the like occurs. Therefore, a method for cooling a metal die by applying a large amount of the water-soluble release agent is used. A water-soluble release agent characterized by containing a water-soluble and/or water-dispersible resin having a glass transition point of 30° C. or lower has been proposed (for example, refer to Patent Literature 1).

However, in the water-soluble release agent, in general, the release agent is diluted with water, and a large amount thereof is applied to be used, and therefore an application amount tends to be large. Therefore, application time and drying time are necessary. This causes impediment of reduction in cycle time. Adhesion to a metal die at a high temperature is also insufficient. The water-soluble release agent has large vaporization heat, and cools a metal die rapidly. Therefore, this causes reduction in lifetime of a metal die.

As a conventional oil-based release agent, a die casting oil-based release agent exhibiting excellent releasability even when a metal die temperature is high (for example, refer to Patent Literature 2), a die casting release agent which has improved a working environment due to reduction in generation of oil mist and improved releasability (for example, refer to Patent Literature 3), and an oil-based release agent for die casting, containing a solvent having a flash point of 70 to 170° C. and a silicone oil having a kinematic viscosity of 150 $mm^2/s$ or more at 40° C. (for example, refer to Patent Literature 4) have been proposed. However, these oil-based release agents have insufficient lubricity at a high temperature. The die casting oil-based release agent according to Patent Literature 2 is a die casting release agent having a high viscosity, applied to a surface of a metal die by brush application, and therefore has a poor application efficiency, causing impediment of reduction in cycle time.

CITATION LIST

Patent Literatures

Patent Literature 1: JP 07-062380 A
Patent Literature 2: JP 4953117 B1
Patent Literature 3: JP 2011-56518 A
Patent Literature 4: JP 4095102 B1
Patent Literature 5: JP 4764927 B1

SUMMARY OF INVENTION

Technical Problem

The present invention has been achieved in view of the above circumstances, and provides an oil-based release agent adhering to a metal die at a high temperature of 300° C. or higher even with application in a small amount and having stable lubricating performance with respect to the metal die at a high temperature while a working environment is considered and lifetime of the metal die is improved. In addition, the present invention provides a method for applying an oil-based release agent, capable of reducing accumulation of a lubricating component.

Solution to Problem

The present invention relates to a high temperature heat-resistant oil-based release agent containing a petroleum-based hydrocarbon solvent (a) and a high temperature adhesive (b).

The present invention relates to a high temperature heat-resistant electrostatic application-type oil-based release agent containing the petroleum-based hydrocarbon solvent (a) and a low volatile conductive modifier (f) and having an electric resistance of 3 to 400 MΩ.

The present invention relates to a high temperature heat-resistant electrostatic application-type oil-based release agent containing the petroleum-based hydrocarbon solvent (a) and a sorbitan type solubilizing agent in an amount of 0.3% by mass or more and less than 5% by mass and having an electric resistance of 3 to 400 MΩ.

The present invention relates to a method for applying a high temperature heat-resistant oil-based release agent, including applying the above high temperature heat-resistant oil-based release agent to a metal die at a particle speed of 2 to 50 m/s so as to have a mist diameter of 0.1 to 60 μm.

The present invention relates to a method for electrostatically applying a high temperature heat-resistant electrostatic application-type oil-based release agent, including applying the above high temperature heat-resistant electrostatic application-type oil-based release agent to a metal die.

Advantageous Effects of Invention

The present invention can provide an oil-based release agent having excellent adhesion or excellent lubricity even with respect to a metal die at a high temperature of 300° C. or higher, and a method for applying an oil-based release agent, reducing accumulation of a lubricating component of this oil-based release agent to cause defectiveness of a work when the release agent is applied.

DESCRIPTION OF EMBODIMENTS

Figure 1:
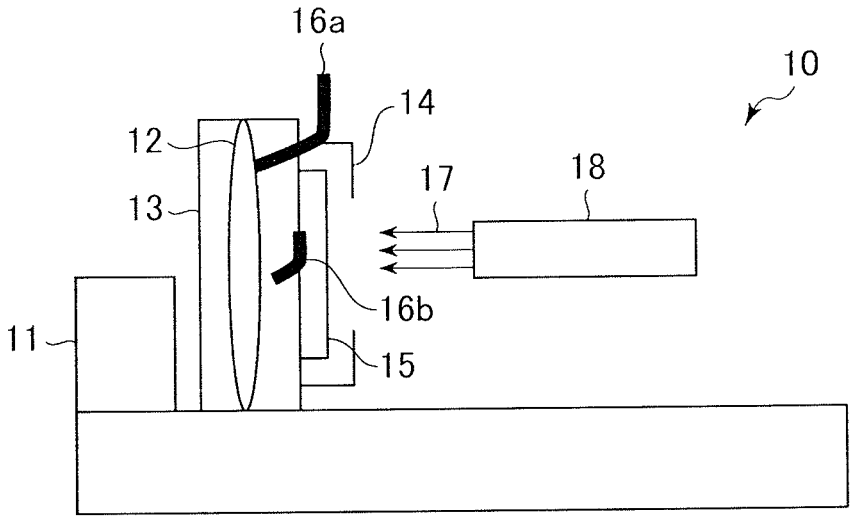
FIG. 1 is a schematic diagram illustrating an adhesion tester for testing an adhesion amount according to first and second embodiments.

Hereinafter, high temperature adhesion and small amount application will be described, and then the present invention will be described in detail.

<High Temperature Adhesion and Small Amount Application>

The Leidenfrost temperature of water itself is about 160° C. A water-soluble release agent mainly contains water. Even a water-soluble release agent containing fat and oil or the like has a Leidenfrost temperature of about 180 to 200° C. Therefore, a water-soluble release agent is applied to a metal die at a high temperature of 200° C. or higher, bumping occurs, and it is difficult to make a component of the release agent adhere to the metal die. When the temperature of the metal die is partially high, a large amount of the water-soluble release agent is applied to cool the metal die. Therefore, the application amount of the water-soluble release agent is increased largely.

In contrast, an oil-based release agent according to the embodiments mainly contains a petroleum-based saturated hydrocarbon solvent, and therefore can make a Leidenfrost temperature 300° C. or higher. Therefore, the temperature at which bumping occurs can be raised. Therefore, the oil-based release agent can adhere to a metal die even when the temperature of the metal die is 300° C. or higher. Adhesion to a metal die at a high temperature of 300° C. or higher is high, and therefore an application amount to the metal die can be smaller than that of a water-soluble release agent.

An oil-based release agent according to a first embodiment contains a high temperature adhesive (b), and therefore can maintain stable lubricity even with respect to a metal die at 300° C. or higher, and can maintain desired lubricity. The high temperature adhesive (b) is a component capable of making a remaining amount in a metal die at a high temperature of 300° C. or higher twice or more that of an additive or the like used in a conventional oil-based lubricant, and will be described in detail in the following embodiments.

By adjusting a content of an additive other than the high temperature adhesive (b) in the oil-based release agent according to the embodiments, it is possible to enlarge a range of an application temperature, improve a coating film strength, further raise the Leidenfrost temperature, and the like. A stable adhesion amount can be thereby maintained even with respect to a metal die at 400° C. or higher. Other additives will be described in detail in the following embodiments.

Oil has lower surface tension than water, and can extend a coating film thinly. Therefore, the oil-based release agent of the embodiments has excellent high temperature adhesion even with application in a small amount.

By adjusting an electric resistance of the oil-based release agent according to the embodiments to 3 to 400 MΩ, the oil-based release agent can be applied to a metal die electrostatically. Due to this electrostatic effect, adhesion can be further enhanced, and adhesion at a high temperature can be maintained due to containing no water causing impediment of high temperature adhesion, as described in a second embodiment.

The oil-based release agents according to the first and second embodiments can be used for metal die casting or die casting of aluminum, magnesium, zinc, or a non-ferrous metal such as an alloy containing these elements.

First Embodiment

The first embodiment provides an oil-based release agent containing a petroleum-based hydrocarbon solvent (a) and a high temperature adhesive (b).

<Oil-Based Release Agent>

The oil-based release agent needs to have a flash point equal to or higher than the temperature at a work place using the oil-based release agent. The flash point is preferably higher than a flash point of kerosene 43° C., that is, 70° C. or higher. Meanwhile, the oil-based release agent desirably has a high drying property. When the oil-based release agent has a low drying property and remains in a metal die, the oil-based release agent drips and flows, causes unevenness in thickness of a coating film, and causes seizure, variation in dimensional accuracy due to accumulation of a release component, or the like. An oil-based release agent having a high volatilization speed such as a quick-drying paint, that is, an oil-based release agent having a flash point of 170° C. or less to have moderate volatility is preferable. Therefore, the flash point of the oil-based release agent is preferably in a range of 70° C. to 170° C.

Examples of a method for applying the oil-based release agent include brush application, roller application, and application with a spraying apparatus. The brush application and the roller application are effective for thick application, but easily cause unevenness in thickness. Therefore, application with a spraying apparatus is preferable. When the kinematic viscosity of the oil-based release agent at 40° C. is less than 2 $mm^2/s$, a spray pump for a spraying apparatus may be worn. By adjusting a pumping apparatus such as a gear pump, an air pressure, a diameter of a discharge port of a spray gun, or the like, application is possible as long as the kinematic viscosity of the oil-based release agent at 40° C. is 1000 $mm^2/s$ or less. However, when the kinematic viscosity is more than 1000 $mm^2/s$, spraying properly may be impossible. Therefore, the kinematic viscosity of an oil-based release agent at 40° C. is preferably from 2 to 1000 $mm^2/s$. The kinematic viscosity at 40° C. is more preferably from 2 to 200 $mm^2/s$, and still more preferably from 2 to 50 $mm^2/s$ from a viewpoint of stability of spray.

(1) Petroleum-Based Hydrocarbon Solvent (a)

A solvent in the oil-based release agent needs to evaporate on a surface of a metal die after the oil-based release agent is applied to the metal die. This forms a dry coating film of an active component, and secures lubricity. When a solvent having a low evaporation property to make an evaporation residue is used, the oil-based release agent drips and flows to affect lubricity adversely. Therefore, a solvent having a high evaporation property and a high drying property is preferable. The petroleum-based hydrocarbon solvent (a) having a high content of a saturated hydrocarbon and a high purification degree with extremely low sulfur and nitrogen contents is preferable.

Examples of the petroleum-based hydrocarbon solvent (a) include a paraffinic hydrocarbon solvent which is a saturated chain compound, an olefinic hydrocarbon solvent which is a chain hydrocarbon having a double bond, a naphthenic hydrocarbon solvent containing at least one saturated ring in one molecule, and an aromatic hydrocarbon solvent containing at least one aromatic ring in one molecule.

A petroleum-based saturated hydrocarbon solvent (also referred to as paraffinic hydrocarbon solvent) has a smaller viscosity change due to a temperature difference than other petroleum-based hydrocarbon solvents (olefinic, naphthenic, and aromatic hydrocarbon solvents). As a result, the petroleum-based saturated hydrocarbon solvent has high application stability in application with a spray. The petroleum-based saturated hydrocarbon solvent has higher chemical reactivity and higher stability than other petroleum-based hydrocarbon solvents, and therefore a lubricating component or the like does not change its nature easily. Therefore, among these petroleum-based hydrocarbon solvents (a), the petroleum-based saturated hydrocarbon solvent is preferable.

The petroleum-based saturated hydrocarbon solvent is classified into a straight-chain normal paraffin and an isoparaffin having a side chain. Among these solvents, a normal paraffin has a small change in viscosity with temperature. Therefore, a straight-chain petroleum-based saturated hydrocarbon solvent (normal paraffin-based hydrocarbon solvent) is more preferable.

Specific examples of the straight-chain petroleum-based saturated hydrocarbon solvent include petroleum-based saturated hydrocarbon solvents such as decane, undecane, dodecane, tridecane, tetradecane, pentadecane, and hexadecane. Among petroleum-based saturated hydrocarbons which are liquid at normal temperature, a petroleum-based saturated hydrocarbon having 10 or more carbon atoms is preferable. A petroleum-based saturated hydrocarbon solvent having 13 to 18 carbon atoms is more preferable from a viewpoint of a drying property on a surface of a metal die.

As the petroleum-based saturated hydrocarbon solvent, it is preferable to use one kind of solvent mainly containing a petroleum-based saturated hydrocarbon solvent having 13 to 18 carbon atoms, or two or more kinds of solvents such as a petroleum-based saturated hydrocarbon solvent having 13 to 18 carbon atoms, a petroleum-based saturated hydrocarbon solvent having carbon atoms outside this range, and the like.

The petroleum-based saturated hydrocarbon solvent is preferably a component contained in the oil-based release agent in the largest amount, that is, a main component. Specifically, the content of the petroleum-based saturated hydrocarbon solvent is preferably from 50 to 98% by mass with respect to the total amount of the oil-based release agent. This is because of the following reasons. When the content of the petroleum-based saturated hydrocarbon solvent is less than 50% by mass, a drying property on a surface of a metal die may be reduced. Meanwhile, when the content of the petroleum-based saturated hydrocarbon solvent is more than 98% by mass, a coating film on a surface of a metal die is thin, and therefore lubricity of the oil-based release agent may be reduced. The content of the petroleum-based saturated hydrocarbon solvent is more preferably from 60 to 98% by mass, and still more preferably from 60 to 95% by mass with respect to the total amount of the oil-based release agent.

(2) High Temperature Adhesive (b)

In a metal die at 300° C. or higher, a conventional lubricating component is almost decomposed, and therefore stable lubricity cannot be maintained easily. The lubricating component which has become decomposed gas is mixed with molten metal and remains in a work as a blow hole, causing deterioration of strength of the work.

The high temperature adhesive (b) according to the first embodiment needs to have high adhesion even with respect to a metal die at 300° C. or higher. After adhering to the metal die, the high temperature adhesive (b) needs to remain as much as possible as a lubricating component in the metal die.

As a result of intensive studies, by blending the high temperature adhesive (b) such as a polymer material which does not easily evaporate even with respect to a metal die at a high temperature to the oil-based release agent, it has become possible to improve adhesion at a high temperature. Specifically, by blending the high temperature adhesive (b) such as a polymer material having a low evaporation property to an oil-based release agent, it has become possible to make a remaining amount of a lubricating component in a metal die at a high temperature of 300° C. or higher twice or more that of a conventional lubricating component. As a result, stable lubricity can be obtained.

The high temperature adhesive (b) will be described in more detail. In order to maintain a remaining amount in a metal die at a high temperature, a polymer material having a weight average molecular weight of 100,000 or more is preferable. This is because of the following. That is, when the weight average molecular weight is less than 100,000, a boiling point is lowered, and a polymer material easily evaporates or becomes decomposed gas by heat, and therefore it is difficult to secure the remaining amount of the lubricant material in a die at a high temperature. The weight average molecular weight of the high temperature adhesive (b) is preferably from 100,000 to 1,000,000, and more preferably from 100,000 to 500,000.

Examples of the high temperature adhesive (b) include a fluororesin, polysulfone, a phenolic resin, an epoxy resin, and a silicon-containing compound which are highly high temperature heat-resistant polymer materials. From among these compounds, one or more kinds thereof are preferably selected.

Examples of the silicon-containing compound include silicone having a siloxane bond as a main chain. The siloxane bond has a stronger bonding energy than a carbon-carbon bond which is a skeleton of a general organic polymer. Therefore, the silicone having a siloxane bond has strong high temperature heat resistance. Therefore, among the high temperature adhesives (b) exemplified above, the silicon-containing compound is more preferable. Among the compounds having a siloxane bond, in a case of a compound having a substituent such as an amino group or a phenyl group in a side chain of a resin skeleton or at a terminal thereof, thermal decomposition thereof may generate toxic gas or a smell. Therefore, the high temperature adhesive (b) is preferably a silicon-containing compound having a weight average molecular weight of 100,000 or more and having a siloxane bond, and more preferably dimethyl polysiloxane having a weight average molecular weight of 100,000 or more. Dimethyl polysiloxane is a compound very stable even at a high temperature. When dimethyl polysiloxane is used, a release coating film is not necessarily formed with a metal die below 200° C., but a release coating film is formed with a metal die at 300° C. or higher, and therefore stable lubricity is obtained. Dimethyl polysiloxane has lower surface tension than water similarly to the petroleum-based saturated hydrocarbon (a). Therefore, dimethyl polysiloxane has a high wetting property on a surface of a metal die. As a result, when being applied by a spray, dimethyl polysiloxane is hardly repelled, and therefore adhesion is improved. Dimethyl polysiloxane has high compatibility with a petroleum-based saturated hydrocarbon solvent. Therefore, unlike a water-soluble release agent mainly containing water, it is not necessary to use an emulsifier causing impediment of lubricity, and therefore lubricity is secured easily.

The content of the high temperature adhesive (b) is preferably from 2 to 50% by mass, more preferably from 2 to 40% by mass, and still more preferably from 4 to 20% by mass with respect to the total amount of the oil-based lubricant. When the content of the high temperature adhesive (b) is less than 2% by mass, stable lubricating performance is not necessarily obtained. When the content of the high temperature adhesive (b) is more than 50% by mass, accumulation may be caused.

(3) Other Additives

By blending another additive in addition to the above compounds, various effects can be imparted. Specifically, by blending another additive, it is possible to further raise a Leidenfrost temperature. In addition, in a case of a large-sized metal die, the metal die has temperature unevenness, and therefore it is possible to maintain lubricity, to further improve adhesion, and to further improve heat resistance in a wide range of temperature corresponding thereto, for example.

Examples of another additive include a lubricating additive (c), a wetting property improver (d), an antioxidant (e), an antirust agent, a preservative, a defoaming agent, an extreme pressure additive, and a cleaning dispersant. These other additives can be blended to be used appropriately as necessary. From among these additives, one or more kinds thereof are preferably selected.

By adding the lubricating additive (c) to the oil-based release agent, the boiling point of the oil-based release agent itself becomes higher, and therefore the Leidenfrost temperature can be further raised. In addition, blending components suitable for a temperature range of a metal die can be combined. Therefore, due to the lubricating additive (c), it is possible to cope even with a case where there is a difference in a temperature range in a large metal die or the like.

Examples of the lubricating additive (c) include a high viscosity mineral oil (c-1), animal and vegetable fat and oil and a higher fatty acid ester (c-2), an organic molybdenum compound (c-3), and an oil-soluble soap (c-4).

The high viscosity mineral oil (c-1) makes a lubricating film thick in a temperature range of 150 to 300° C., and has excellent lubricity. This high viscosity mineral oil (c-1) is preferably a mineral oil and/or a synthetic oil having such a high viscosity as a kinematic viscosity of 100 $mm^2/s$ or more at 40° C., and preferably has a flash point of 250° C. or higher.

Examples of the high viscosity mineral oil include base oil, spindle oil, machine oil, motor oil, cylinder oil, lubricating oil for a raw material. Examples of synthetic oil having a high viscosity include a poly α-olefin (an ethylene-propylene copolymer, polybutene, 1-octene oligomer, 1-decene oligomer, hydrides thereof, or the like), a monoester (butyl stearate or octyl laurate), a diester (ditridecyl glutarate, di-2-ethylhexyl adipate, diisodecyl adipate, ditridecyl adipate, di-2-ethylhexyl sebacate, or the like), a polyester (a trimellitic acid ester or the like), a polyol ester (trimethylolpropane caprylate, trimethylolpropane pelargonate, pentaerythritol-2-ethyl hexanoate, pentaerythritol pelargonate, or the like), polyoxyalkylene glycol, polyphenyl ether, dialkyl diphenyl ether, and a phosphate (tricresyl phosphate or the like).

The animal and vegetable fat and oil and a higher fatty acid ester (c-2) have excellent lubricating performance in a temperature range of 250° C. or lower. Examples of the animal and vegetable fat and oil include rapeseed oil, soybean oil, coconut oil, palm oil, beef oil, and lard. Examples of the higher fatty acid ester include a fatty acid ester, and a monohydric alcohol ester and a polyhydric alcohol ester of a higher fatty acid such as coconut oil fatty acid, oleic acid, stearic acid, lauric acid, palmitic acid, or tallow fatty acid.

By adding the organic molybdenum compound (c-3) or the oil-soluble soap (c-4), the oil-based release agent can obtain excellent lubricity in a wide temperature range.

Specific examples of the organic molybdenum compound (c-3) include MoDDC, MoDTC, MoDDP, and MoDTP. As the organic molybdenum compound (c-3), MoDDC or MoDTC which contains no phosphorus and may react with an aluminum alloy or the like is more preferable.

Examples of the oil-soluble soap (c-4) include a sulfonate, a phinate, and a salicylate of calcium or magnesium, and an organic acid metal salt.

It is preferable to use one kind of the lubricating additive (c) or to mix and use two or more kinds thereof.

When the content of the lubricating additive (c) is more than 20% by mass with respect to the total amount of the oil-based release agent, the kinematic viscosity of the oil-based release agent may be increased, and a spray state may be unstable. In addition, this may cause adhesion of the lubricating additive (c) to a work. When the content of the lubricating additive (c) is less than 1% by mass, an oil film is insufficient, and seizure or the like occurs. Therefore, the content of the lubricating additive (c) is preferably 20% by mass or less, more preferably from 2 to 18% by mass, and still more preferably from 2 to 15% by mass.

By further using the wetting property improver (d), improvement of a wetting property of the oil-based release agent according to the embodiment with respect to a metal die can be expected, and further improvement of adhesion even with respect to a metal die at a high temperature can be expected.

Examples of the wetting property improver (d) include acrylic copolymer and acrylic-modified polysiloxane. It is preferable to use one kind of the wetting property improver (d) or to mix and use two or more kinds thereof. The content of the wetting property improver (d) is preferably from 0.1 to 5% by mass, and more preferably from 0.1 to 3% by mass. Even when the content of the wetting property improver (d) is more than 5% by mass, there is a tendency that a more effect cannot be obtained.

Further presence of the antioxidant (e) in the oil-based release agent can delay deterioration of an oil film, and can maintain high temperature lubricity. Examples of the antioxidant (e) include an amine antioxidant (e-1), a phenolic antioxidant (e-2), and a cresol antioxidant (e-3).

Examples of the amine antioxidant (e-1) include a monoalkyl diphenylamine such as monononyl diphenylamine; a dialkyl diphenylamine such as 4,4'-dibutyl diphenylamine, 4,4'-dipentyl diphenylamine, 4,4'-dihexyl diphenylamine, 4,4'-heptyl diphenylamine, 4,4'-dioctyl diphenylamine, or 4,4'-dinonyl diphenylamine; a polyalkyl diphenylamine such as tetrabutyl diphenylamine, tetrahexyl diphenylamine, tetraoctyl diphenylamine, or tetranonyl diphenylamine; α-naphthylamine, phenyl-α-naphthylamine, butylphenyl-α-naphthylamine, pentylphenyl-α-naphthylamine, hexylphenyl-α-naphthylamine, heptylphenyl-α-naphthylamine, and octylphenyl-α-naphthylamine.

Examples of the phenolic antioxidant (e-2) include 2,6-di-tert-butyl-4-methylphenol, 2,6-di-tert-butyl-4-ethylphenol, 4,4-methylene bis(2,6-di-tert-butylphenol), 2,2-methylene bis(4-ethyl-6-butylphenol), high-molecular-weight single ring phenolic, polycyclic tert-butylphenol, butylated hydroxy toluene (BHT), and butylated hydroxy anisole (BHA).

Examples of the cresol antioxidant (e-3) include di-tert-butyl paracresol and 2-6-di-tert-butyl-dimethylamino-p-cresol. Among the above antioxidants, a mixture of BHT and an alkyl diphenylamine is preferable.

It is preferable to use one kind of the antioxidant (e) or to mix and use two or more kinds thereof. The content of the antioxidant (e) is preferably from 0.1 to 5% by mass, and more preferably from 0.1 to 3% by mass with respect to the total amount of the oil-based release agent. Even when the content of the antioxidant (e) is more than 5% by mass, there is a tendency that a more effect cannot be obtained similarly to the wetting property improver (d).

An antirust agent, a preservative, a defoaming agent, an extreme pressure additive, a cleaning dispersant, and the like can be blended to be used appropriately as necessary. From among these agents, one or more kinds thereof are preferably selected.

Second Embodiment (4) Low Volatile Conductive Modifier (f)

By using a technology of electrostatically applying an oil-based release agent for casting by the present inventors (Patent Literature 5), the oil-based release agent according to the first embodiment can be applied electrostatically. This increases adhesion of an oil-based release agent largely. Therefore, a sufficient oil film can be formed without applying the oil-based release agent excessively even in a hidden portion, an uneven portion, or a thin portion in a metal die becoming complex. However, this electrostatic application technology does not correspond to high temperature heat resistance. Therefore, improvement is necessary in order to correspond to high temperature heat resistance.

A petroleum-based saturated hydrocarbon solvent has no polarity or conductivity. Therefore, the electric resistance thereof is infinite. Therefore, the oil-based saturated hydrocarbon solvent itself is unsuitable for electrostatic application. In order to perform electrostatic application, an oil-based release agent preferably has an electric resistance of 3 to 400 MΩ in view of design of an electrostatic apparatus. When the electric resistance is less than 3 MΩ, an oil-based release agent is not charged, a charge is leaked to the apparatus side, and an electrostatic effect disappears. When the electric resistance is more than 400 MΩ, the electric resistance is too high, and an oil-based release agent is hardly charged. Presence of water in an oil-based release agent lowers the Leidenfrost temperature, causing impediment of high temperature adhesion. A solubilizing agent causes impediment of lubricity.

Therefore, in order to apply an oil-based release agent electrostatically, the electric resistance is required to be 3 to 400 MΩ. In order to further enhance high temperature heat resistance, the oil-based release agent is required to contain no water and no solubilizing agent or an extremely small amount thereof. The electric resistance of the oil-based release agent is more preferably from 5 to 400 MΩ, and still more preferably from 10 to 400 MΩ.

As a result of intensive studies, it has been found that an optimal electric resistance is obtained without lowering the Leidenfrost temperature by blending a low volatile conductive modifier (f) in an oil-based release agent.

According to the second embodiment, by using a petroleum-based hydrocarbon solvent (a) and the low volatile conductive modifier (f), an oil-based release agent having high adhesion even with respect to a metal die at a high temperature can be provided.

As the petroleum-based hydrocarbon solvent (a), those exemplified in the first embodiment can be used. The content of the petroleum-based hydrocarbon solvent (a) is preferably from 50 to 99.9% by mass, more preferably from 60 to 99.9% by mass, and still more preferably from 65 to 99.9% by mass with respect to the total amount of the oil-based release agent.

Examples of the low volatile conductive modifier (f) include an ionic liquid (also referred to as ion liquid). In the ionic liquid, molecules are bonded to each other not by an intermolecular attraction but by a strong ionic bond. Therefore, the ionic liquid has high thermal stability, and hardly evaporates even at a high temperature. Therefore, it is possible to further enhance adhesion with respect to a metal die at a high temperature as compared to a case where water or another organic solvent is blended. The ionic liquid has high ion conductivity, and therefore only by adding a small amount thereof to the oil-based release agent, the electric resistance of the oil-based release agent can be optimal.

Examples of the ionic liquid include an imidazolium salt (f-1), a pyrrolidinium salt (f-2), a pyridinium salt (f-3), an ammonium salt (f-4), a phosphonium salt (f-5), and a sulfonium salt (f-6).

Examples of the imidazolium salt (f-1) include 1,3-dimethyl imidazolium chloride, 1,3-dimethyl imidazolium dimethylphosphate, 1-ethyl-3-methyl-imidazolium chloride, 1-ethyl-3-methyl-imidazolium bromide, 1-ethyl-3-methyl-imidazolium iodide, 1-ethyl-3-methyl-imidazolium methane sulfonate, 1-ethyl-3-methyl-imidazolium trifluoromethane sulfonate, 1-ethyl-3-methyl-imidazolium trifluoro (trifluoromethyl) borate, 1-ethyl-3-methyl-imidazolium hydrogensulfate, 1-ethyl-3-methyl-imidazolium ethyl sulfate, 1-ethyl-3-methyl-imidazolium 2-(2-methoxyethoxy) ethyl sulfate, 1-ethyl-3-methyl-imidazolium dicyanamide, 1-ethyl-3-methyl-imidazolium tetrafluoroborate, 1-ethyl-3-methyl-imidazolium hexafluorophosphate, 1-ethyl-3-methyl-imidazolium bis(trifluoromethanesulfonyl)-imide, 1-ethyl-3-methyl-imidazolium p-toluenesulfonate, 1-ethyl-3-methyl-imidazolium tetrachloroferrate, 1-methyl-3-propyl-imidazolium iodide, 1-butyl-3-methyl-imidazolium chloride, 1-butyl-3-methyl-imidazolium bromide, 1-butyl-3-methyl-imidazolium tribromide, 1-butyl-3-methyl-imidazolium iodide, 1-butyl-3-methyl imidazolium trifluoromethanesulfonate, 1-butyl-3-methyl imidazolium trifluoro (trifluoromethyl) borate, 1-butyl-3-methyl imidazolium tetrafluoroborate, 1-butyl-3-methyl imidazolium hexafluorophosphate, 1-butyl-3-methyl imidazolium bis(trifluoromethanesulfonyl) imide, 1-butyl-3-methyl-imidazolium tetrachloroferrate, 1-hexyl-3-methyl-imidazolium chloride, 1-hexyl-3-methyl-imidazolium bromide, 1-hexyl-3-methyl-imidazolium tetrafluoroborate, 1-hexyl-3-methyl-imidazolium hexafluorophosphate, 1-methyl-3-n-octyl imidazolium chloride, 1-methyl-3-n-octyl imidazolium bromide, 1-methyl-3-n-octyl imidazolium hexafluorophosphate, 1-ethyl-2,3-dimethyl imidazolium bis(trifluoromethanesulfonyl) imide, 1,2-dimethyl-3-propyl imidazolium iodide, 1-butyl-2,3-dimethyl imidazolium chloride, 1-butyl-2,3-dimethyl imidazolium tetrafluoroborate, 1-butyl-2,3-dimethyl imidazolium hexafluorophosphate, and 1-butyl-2,3-dimethyl imidazolium bis (trifluoromethane sulfonate) imide.

Examples of the pyrrolidinium salt (f-2) include 1-methyl-1-propyl-pyrrolidinium bis(trifluoromethanesulfonyl) imide, 1-butyl-1-methyl-pyrrolidinium chloride, 1-butyl-1-methyl pyrrolidinium bromide, and 1-butyl-1-methyl pyrrolidinium bis(trifluoromethanesulfonyl) imide.

Examples of the pyridinium salt (f-3) include 1-ethyl-pyridinium chloride, 1-ethyl pyridinium bromide, 1-butyl pyridinium chloride, 1-butyl pyridinium bromide, 1-butyl pyridinium tetrafluoro borate, 1-butyl pyridinium hexafluorophosphate 1-butyl-3-methylpyridinium chloride, 1-butyl-3-methyl-pyridinium bromide, 1-ethyl-3-methyl pyridinium ethyl sulfate, 1-ethyl-3-methylpyridinium bis(trifluoromethanesulfonyl) imide, 1-ethyl-3-(hydroxymethyl)-pyridinium ethyl sulfate, 1-butyl-4-methylpyridinium chloride, 1-butyl-4-methylpyridinium bromide, and 1-butyl-4-methylpyridinium hexafluorophosphate.

Examples of the ammonium salt (f-4) include trimethylpropyl ammonium bis(trifluoromethanesulfonyl) imide, amyltriethyl ammonium bis (trifluoromethanesulfonyl) imide, tributylmethyl ammonium bis(trifluoromethanesulfonyl) imide, tetrabutyl ammonium chloride, tetrabutyl ammonium bromide, methyltri-n-octyl ammonium bis (trifluoromethanesulfonyl) imide, and cyclohexanyl trimethyl ammonium bis (trifluoromethanesulfonyl) imide.

Examples of the phosphonium salt (f-5) include tetrabutylphosphonium bromide, tributyl methyl phosphonium bis (trifluoromethanesulfonyl) imide, tributyl (2-methoxyethyl)-phosphonium bis(trifluoromethanesulfonyl) imide, and tributyl hexadecyl phosphonium bromide.

Examples of the sulfonium salt (f-6) include triethyl sulfonium bis(trifluoromethanesulfonyl) imide.

As the low volatile conductive modifier (f), it is preferable to use one kind of the ionic liquid or to mix and use two or more kinds thereof.

The pyridinium salt (f-3) has low compatibility with a petroleum-based saturated hydrocarbon solvent, and therefore is not dispersed therein easily. Among the ionic liquids, as the low volatile conductive modifier (f), the imidazolium salt (f-1) is more preferable from a viewpoint of compatibility with the petroleum-based saturated hydrocarbon solvent.

The content of the low volatile conductive modifier (f) is preferably from 0.1 to 5% by mass, and more preferably from 0.1 to 2% by mass with respect to the total amount of the oil-based release agent. When the content of the low volatile conductive modifier (f) is more than 5% by mass, the oil-based release agent has a too good electric conductivity, and the electric resistance thereof tends to be outside an optimal range of the electric resistance. When the low volatile conductive modifier (f) has poor compatibility with the petroleum-based hydrocarbon solvent (a) as a main component of the oil-based release agent, white turbidity or separation may be caused. The oil-based release agent which has caused white turbidity or separation has an unstable electric resistance. As a result, a stable effect of electrostatic application is not necessarily obtained.

(5) Solubilizing Agent (g)

By adding the above low volatile conductive modifier (f) to the oil-based release agent, the heat-resistant oil-based release agent can be applied electrostatically. When dispersion stability of the low volatile conductive modifier (f) is low, white turbidity or separation may occur. In order to stabilize the quality of the oil-based release agent, the oil-based release agent may contain a solubilizing agent (g).

Examples of the solubilizing agent (g) include an alcohol, a glycol, an ester, an ether, a ketone, and an emulsifier. The alcohol or the glycol dissolves water well, but may cause separation in the petroleum-based hydrocarbon solvent (a). The emulsifier is less volatile and safer than the ether, the ketone, or the ester. In order to dissolve the low volatile conductive modifier (f) in the petroleum-based hydrocarbon solvent (a) having low polarity, an emulsifier type solubilizing agent is preferable among these solubilizing agents (g). A nonionic solubilizing agent having both a hydrophilic group and a lipophilic group is more preferable. A nonionic type solubilizing agent has a lowest concentration (critical micelle concentration) to form a molecular assembly (micelle) much lower than another ionic solubilizing agent such as an anionic type or a cationic type. Therefore, an addition amount of the solubilizing agent can be reduced. Addition of a small amount of the nonionic type solubilizing agent allows the solubilizing agent to form a micelle, and therefore high viscosity or white turbidity of the oil-based release agent can be prevented. This improves dispersion stability of the low volatile conductive modifier (f). As a result, the electric resistance of the oil-based release agent according to the embodiment can be stabilized in an optimal range of the electric resistance.

Hydrophile-lipophile balance (HLB) is a value representing the degree of affinity with oil or water. HLB is from 0 to 20. HLB closer to 0 represents higher lipophilicity. HLB closer to 20 represents higher hydrophilicity. That is, a substance having HLB of less than 10 is not easily dissolved in water, but is easily dissolved in oil. A substance having HLB of more than 10 is easily dissolved in water, but is not easily dissolved in oil. In order to stabilize the quality of the oil-based release agent, the oil-based release agent needs to have high oil-solubility. Therefore, the solubilizing agent has HLB preferably of 2 to 10, more preferably of 3 to 8.

Any emulsifier type solubilizing agent having HLB in this range can be used. Examples of the emulsifier type solubilizing agent include a phenol-ether type and a sorbitan type. Among these compounds, the sorbitan type solubilizing agent is more preferable from a viewpoint of compatibility.

A large content of the solubilizing agent (g) affects lubricity adversely. A too small content thereof causes separation. Therefore, it is necessary to optimize the content of the solubilizing agent. When the content of the solubilizing agent (g) is less than 0.3% by mass with respect to the total amount of the oil-based release agent, sufficient solubilization is not performed, and the petroleum-based hydrocarbon solvent (a) may be separated from the low volatile conductive modifier (f). When the content of the solubilizing agent is more than 30% by mass, the oil-based release agent may cause white turbidity. Therefore, when the low volatile conductive modifier (f) and the solubilizing agent (g) are mixed to be used, the content of the solubilizing agent (g) is preferably from 0.3 to 30% by mass. Considering an adverse effect of a dispersion effect or lubricity, the content of the solubilizing agent (g) is more preferably more than 1% by mass and 15% by mass or less with respect to the total amount of the oil-based release agent.

The solubilizing agent itself has electric conductivity. Therefore, a desired electric resistance can be obtained by adding only the solubilizing agent (g) without adding the low volatile conductive modifier (f). However, a large amount of the solubilizing agent (g) blended causes impediment of lubricity. Therefore, it is necessary to make the content of the solubilizing agent (g) as little as possible. Among solubilizing agents having HLB of 2 to 10, particularly, a sorbitan type solubilizing agent has high compatibility with the petroleum-based hydrocarbon solvent (a), and can reduce the content of the solubilizing agent (g). However, a too small content of the solubilizing agent cannot maintain dispersion stability. Therefore, when the low volatile conductive modifier (f) is not blended but only the sorbitan type solubilizing agent is blended, the content of the sorbitan type solubilizing agent is preferably 0.3% by mass or more and less than 5% by mass, and more preferably 2% by mass or more and less than 5% by mass with respect to the total amount of the oil-based release agent.

It is possible to use a combination of one or more kinds selected from the sorbitan type solubilizing agents, or one or more kinds selected from the sorbitan type solubilizing agents and other type solubilizing agents.

It is also possible to use the oil-based release agent according to the second embodiment, containing the petroleum-based hydrocarbon solvent (a) and the low volatile conductive modifier (f), and the solubilizing agent (g) as necessary, in combination with the high temperature adhesive (b) according to the first embodiment. This allows the oil-based release agent to maintain higher high temperature adhesion and have stable lubricity.

The lubricating additive (c), the wetting property improver (d), and the antioxidant (e) according to the first embodiment, and another additive such as an antirust agent, a preservative, a defoaming agent, an extreme pressure additive, a viscosity index improver, or a cleaning dispersant can be used in combination thereof, as necessary.

Third Embodiment

A third embodiment provides a release agent application method for applying a composition containing the high temperature adhesive oil-based release agent according to the first embodiment in order to reduce accumulation of a release component or the like to cause poor appearance of a work.

Application of the high temperature adhesive oil-based release agent according to the first embodiment to a metal die using a general spraying apparatus improves high temperature adhesion of the oil-based release agent. However, this improvement of high temperature adhesion causes accumulation of a release component or the like on the metal die, and causes poor appearance of a work (hot water wrinkle, gas defect, or the like).

By applying a composition containing the oil-based release agent according to the first embodiment in a form of fine particles and controlling an application speed, accumulation of a release component or the like to cause poor appearance of a work is reduced.

Specifically, by adjusting a diameter of a nozzle of a spraying apparatus used, a flow rate, and an air pressure, it is possible to adjust micronization and the application speed.

The mist diameter in applying the oil-based release agent is preferably from 0.1 to 60 μm, more preferably from 5 to 45 μm, and still more preferably from 10 to 30 μm. By setting the mist diameter of the oil-based release agent within this range, the oil-based release agent can be prevented from partially adhering to a metal die excessively, and the oil-based release agent can adhere to the metal die uniformly. As a result, generation of a hot water wrinkle or gas can be suppressed, improving a quality and a yield of a product. When the mist diameter is less than 0.1 μm, mist is scattered along with the air current, and an adhesion amount of the oil-based release agent is reduced. Therefore, there is a tendency that sufficient releasability cannot be obtained. Meanwhile, when the mist diameter is more than 60 μm, the oil-based release agent tends to partially adhere to a metal die excessively.

The particle speed in applying the oil-based release agent is preferably from 2 to 50 m/s, more preferably from 5 to 40 m/s, and still more preferably from 10 to 30 m/s. By setting the particle speed of the oil-based release agent within this range, it is possible to increase an adhesion efficiency of the oil-based release agent to a metal die at a high temperature, and to increase an adhesion amount thereof to the inside of gaps of the metal die. As a result, a release resistance can be reduced, preventing seizure or galling. When the particle speed in applying the oil-based release agent is less than 2 m/s, a collision energy of particles to a metal die is reduced, the adhesion amount of the oil-based release agent is reduced, and therefore there is a tendency that sufficient releasability cannot be obtained. When the particle speed in applying the oil-based release agent is more than 50 m/s, bounce of the mist air current interferes with flying of a subsequent mist, and therefore sufficient adhesion does not occur easily.

As a spraying apparatus used in setting the mist diameter to 0.1 to 60 μm and setting the particle speed to 2 to 50 m/s in applying the oil-based release agent, a well-known apparatus can be used appropriately. However, for example, a release agent dedicated spray gun WFS-05G-R (nozzle diameter: 1 mm, manufactured by Yamaguchi Giken Co., Ltd.) can be used.

The mist diameter and the particle speed of the oil-based release agent can be measured by a Doppler laser particle analyzer.

The flow rate of the oil-based release agent is preferably from 0.01 to 0.6 mL/s, and more preferably from 0.1 to 0.5 mL/s. When the flow rate of the oil-based release agent is less than 0.01 mL/s, the mist diameter and the particle speed tend to be insufficient. Meanwhile, when the flow rate of the oil-based release agent is more than 0.6 mL/s, the mist diameter and the particle speed tend to exceed a desired range.

Fourth Embodiment

A fourth embodiment provides an electrostatic application method for electrostatically applying the heat-resistant electrostatic application-type oil-based release agent according to the second embodiment to a metal die. The heat-resistant electrostatic application-type oil-based release agent according to the second embodiment generates an electrostatic effect due to an electrostatic application apparatus. Therefore, a uniform and sufficient coating film can be formed even in a hidden portion, an uneven portion, or a thin portion of a metal die by a so-called wraparound effect.

As the electrostatic application apparatus, even with a generally-sold electrostatic application apparatus for paint, an effect of increase in an adhesion amount to a metal die at a high temperature can be expected sufficiently. Among the apparatuses, a combination use of an air electrostatic automatic gun Robogan II EAB90 type manufactured by Asahi Sunac Corporation as an electrostatic application gun, a BPS1600 type manufactured by Asahi Sunac Corporation as an electrostatic controller, and a K pump (0.5 $cm^3$) type manufactured by Ransburg Industrial Finishing K.K. or a BHI62ST-18 type manufactured by Oriental Motor Co., Ltd. as a liquid pumping apparatus, is exemplified.

EXAMPLES

Hereinafter, the oil-based release agent of the present invention and a method for applying the oil-based release agent will be described in detail using Examples and Comparative Examples. The present invention is not limited to the following Examples themselves, but can be embodied by modifying constituent elements within a range not departing from the gist thereof. Various inventions can be formed by appropriate combinations of a plurality of constituent elements disclosed in Examples. Some constituent elements may be deleted from all the constituent elements described in Examples. In addition, the constituent elements may be combined to each other so as to form a different embodiment.

(A) Manufacturing Method

Predetermined amounts of the petroleum-based hydrocarbon solvent (a), the high temperature adhesive (b), and the like are input into a household mixer at normal temperature, and are mixed at medium speed rotation of about 300 rpm for three minutes. Thereafter, predetermined amounts of the remaining components are input thereinto, and are stirred at medium speed rotation for about five minutes to obtain an oil-based release agent.

When a heat-resistant electrostatic application-type oil-based release agent is manufactured, a predetermined amount of the low volatile conductive modifier (f) is added after the above mixing work. In this case, stirring is performed at a medium speed rotation number for about ten minutes.

(B) Test Method (B-1) High Temperature Residual Test

A high temperature residual test was performed using a differential thermogravimetric simultaneous measurement device (trade name: "EXSTAR6000 (TG/DTA)", not illustrated) manufactured by Seiko Instruments Inc. (SII) and an analytical electronic balance (trade name: "HR-202", not illustrated) manufactured by A&D Company, Limited (AND). A predetermined amount of sample was heated under predetermined conditions, and change in mass of the sample was measured at that time. Operation procedures in this test will be described below.

10 mg of a sample (oil-based release agent) was put on a measurement dish, and the temperature thereof was raised at a rate of 10° C. per minute up to 500° C. A heat loss ratio (mass %) was measured from change in mass at each temperature.

(B-2) Method for Measuring Flash Point (In Conformity to ASTM D-93)

The flash point of an oil-based release agent was measured by an ASTM D-93 Pensky Martens method.

(B-3) Method for Measuring Kinematic Viscosity (In Conformity to ASTM D445)

The kinematic viscosity of an oil-based release agent at 40° C. was measured according to ASTM D445 (Ubbelohde viscometer).

(B-4) Method for Measuring Leidenfrost Temperature

An iron test piece of 100 mm square and 1 mm thickness was baked in an oven (not illustrated) at 200° C. for 30 minutes. Thereafter, the resulting test piece was cooled in a desiccator such as a moisture proof storage (not illustrated) overnight. This test piece was put on a commercially available electric stove (not illustrated), and was heated. One drop (about 0.1 $cm^3$) of a release agent was dropwise added to a surface center portion of the test piece using a pipette. The droplet was observed immediately after the dropwise addition, the temperature at which boiling occurred under a situation having a relatively less motion was measured, and the temperature at this time was used as a Leidenfrost temperature. When the temperature was high, the droplet splashed. Therefore, in this case, the surface temperature was lowered by 10° C., and the test was performed again. The surface temperature was measured with a non-contact type thermometer.

(B-5) Adhesion Test

FIG. 1 illustrates an adhesion tester 10 for measuring an adhesion amount. The adhesion tester 10 includes a heater 12, a housing 13 incorporating temperature sensors (thermocouple) 16*a* and 16*b*, and a temperature controller 11 connected to the heater 12 and the temperature sensors 16*a* and 16*b*. The temperature controller 11 can emit a signal for heating the heater 12 up to a set temperature. When the temperature becomes a predetermined temperature or higher, the heater 12 can be stopped due to a signal emitted from the temperature sensors 16*a* and 16*b*.

A support bracket 14 for fixing a test piece 15 is disposed on one end surface of the housing 13. The temperature sensor 16*b* for measuring the temperature of the test piece 15 is disposed at the center of the one end surface of the housing 13. By heating the heater 12 in the housing 13, it is possible to heat the test piece 15 held by the support bracket 14. A spraying apparatus 18 can apply a predetermined amount of release agent 17 to the heated test piece 15 for a predetermined time.

The test piece 15 is an iron plate of 100 mm square and 1 mm thickness. Before the test, a test piece obtained by baking this test piece 15 in an oven (not illustrated) at 200° C. for 30 minutes and then cooling the resulting test piece in a desiccator (not illustrated) overnight, is prepared. In addition, before the test, it is necessary to measure the mass of the test piece 15 up to a unit of 0.1 mg.

Operation procedures in this test will be described below. The temperature of the temperature controller 11 of the adhesion tester 10 is set to a predetermined temperature, and the heater 12 is preheated. When the temperature of the temperature sensor 16*a* reaches a predetermined set temperature, the test piece 15 is held in the support bracket 14 on one end surface of the housing 13. At this time, the temperature sensor 16*b* is brought into close contact with the test piece 15, and the test piece 15 is heated. When the temperature sensor 16*b* reaches a predetermined temperature, the spraying apparatus 18 applies a predetermined amount of the release agent 17 to the test piece 15.

The test piece 15 is extracted, and is cooled for a predetermined time while being in a vertical state. Oil dripping and flowing from the test piece 15 is removed. The test piece 15 to which the release agent 17 has been applied is put in an oven at 105° C. for 30 minutes, then is air-cooled, and is cooled in a desiccator in a certain period of time.

The mass of the test piece 15 was measured up to a unit of 0.1 mg, and an adhesion amount was calculated from a difference between masses before and after the test.

The adhesion efficiency represents a comparison of an actual adhesion mass with respect to a mass of active components contained in the applied release agent 17. A calculation method therefor is as follows. That is, adhesion efficiency (%)=adhesion amount (mg)/amounts of active components in the applied release agent (mg)×100.

(B-6) Release Resistance Test

A release resistance is measured using an automatic tensile tester (trade name: Lub Tester U) manufactured by MEC International Co., Ltd. A frictional resistance test plate made of SKD-61 material and having a size of 200 mm×200 mm×34 mm was used. A ring made of S45C material manufactured by MEC International Co., Ltd. and having an inner diameter of 75 mm, an outer diameter of 100 mm, and a height of 50 mm was used. Molten aluminum made of ADC-12 material was used. An iron weight having a weight of 8.8 kg was used.

Figure 2A:
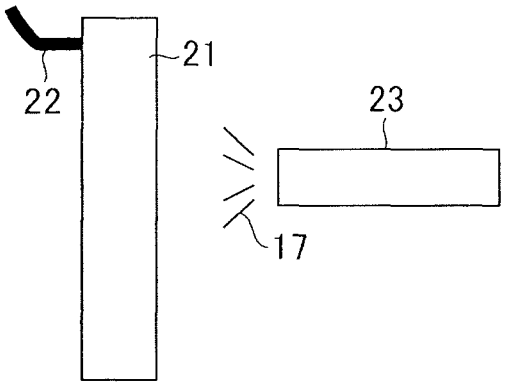
FIGS. 2(A) and 2(B) are schematic process diagrams of a method for measuring a release resistance for testing lubricity according to the first and second embodiments.
Figure 2B:
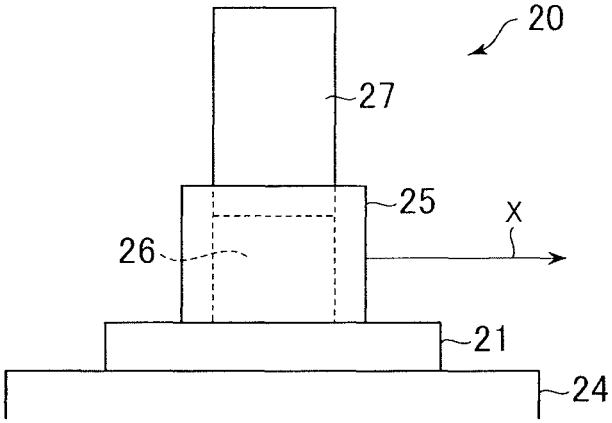

FIGS. 2(A) and 2(B) are schematic process diagrams of a method for measuring a release resistance. As illustrated in FIG. 2(B), an automatic tensile tester 20 includes a tester frame 24, a test plate 21 incorporating a temperature sensor (thermocouple) 22, a ring 25, and an iron weight 27. Molten aluminum 26 is put into the ring 25 to which the release agent 17 has been applied on the test plate 21. By pulling the molten aluminum 26 in an X direction using the ring 25, the release resistance is measured.

Operation procedures in this test will be described below.

In advance, by using a melting furnace for ceramics (not illustrated), an aluminum ingot (not illustrated) is heated up to 650° C. to prepare the molten aluminum 26.

As illustrated in FIG. 2(A), the test plate 21 is heated up to a predetermined temperature using a commercially available heater (not illustrated), and is made to stand vertically in front of a spraying apparatus 22. The release agent 17 is applied to this test plate 21 using the spraying apparatus 22 under predetermined application conditions. This test plate 21 is put horizontally on the tester frame 24, and the ring 25 is put in the center thereof. 90 $cm^3$ of the molten aluminum 26 is poured into the ring 25.

The molten aluminum 26 is cooled for 40 seconds to be solidified. The weight 27 is put on the molten aluminum 26 quietly, and the molten aluminum 26 is pulled in the X direction using the automatic tensile tester 20.

A release resistance was measured using a strain gauge in the automatic tensile tester 20.

(B-7) Method for Measuring Electric Resistance (In Conformity to ASTM D5682)

About 50 cc of a sample of an oil-based release agent was put into a 100 cc beaker, and an electric resistance was measured using an electrostatic tester (type: EM-III) manufactured by Asahi Sunac Corporation. An indicator of the electrical resistance is unstable when a measured value is high. Therefore, an average value of five measurements was used as a measured value. When the electric resistance was in a range of 3 to 400 MΩ, electrostatic application was evaluated as "possible". When the electric resistance was outside the range of 3 to 400 MΩ, electrostatic application was evaluated as "impossible".

(B-8) Dispersibility 20 ml of a sample of an oil-based release agent was put into a test tube, and a white turbidity situation or a separation situation was evaluated visually. A transparent sample having no separation or white turbidity was evaluated as "A". A sample having a little white turbidity was evaluated as "B". A sample having white turbidity and causing separation after long-term storage was evaluated as "C". A sample having white turbidity and causing separation in a short time was evaluated as "D".

(B-9) Real Machine Evaluation: Polishing Lifetime Test

A polishing lifetime test was performed using a real machine (die casting machine of 1650 ton) for confirming performance of a release agent. A step for applying the oil-based release agents obtained in Example 1 and Comparative Example 1 to a metal die of the real machine using an air atomized spray for casting was performed repeatedly. The temperature of the metal die of the real machine was from 300 to 400° C., and the flow rate of the oil-based release agent was from 0.1 to 0.5 mL/s. In this case, the mist diameter was from 10 to 30 μm, and the particle speed was from 10 to 30 m/s. A gun distance from a nozzle tip of the spraying apparatus to the metal die which was an application surface was from 100 to 200 mm.

When small seizure occurs, an aluminum thin film adheres to a predetermined portion of the metal die. Accumulation of this aluminum thin film causes a defect of a product. Before a product becomes defective, aluminum in the metal die is polished to be removed. The number of shots (the number of casting) from the start of casting to polishing was evaluated as a polishing lifetime, and this number was used as an indicator of releasing performance. Evaluation was performed at three observation points in the metal die, at which polishing was particularly necessary. Accumulation of an aluminum thin film in a predetermined area was confirmed visually.

(B-10) Test Condition 1-1

Table 1 shows a blending composition of the oil-based release agent used for the tests according to the first embodiment.

TABLE 1

| | Example 1 | Comparative Example 1 |
|---|---|---|
| Type of release agent | Oil | Oil |
| Solvent*1 (mass %) | 78 | 86 |
| High temperature adhesive*2 (mass %) | 12 | 0 |
| Modified silicone oil*3 (mass %) | 0 | 6 |
| High viscosity mineral oil*4 (mass %) | 6 | 6 |
| Animal and vegetable fat and oil*5 (mass %) | 0.6 | 0.6 |
| Organic molybdenum compound*6 (mass %) | 0.6 | 0.6 |
| Flash point (° C.) | 100 | 97 |
| Kinematic viscosity (40° C.) (Unit: $mm^2/s$) | 37.7 | 5.5 |

*1Solvent: ISOPAR M (Petroleum-based saturated hydrocarbon solvent having 13 to 18 carbon atoms), Exxon Mobil Corporation Flash point: 96° C.

*2High temperature adhesive: Trade name: Element14 PDMS 100K-J (In terms of molecular weight: 105757, Dimethyl polysiloxane having a kinematic viscosity of 100000 $mm^2/s$), Momentive Performance Materials Inc.

*3Modified silicone oil: Trade name: Release agent TN (In terms of molecular weight: 25243-31300, Alkylaralkyl modified polysiloxane having a kinematic viscosity of 900 to 1500 $mm^2/s$), Wacker Asahikasei Silicone Co., Ltd.

*4High viscosity mineral oil: Trade name: Super Oil N460, JX Nippon Oil & Energy Corporation Kinematic viscosity at 40° C.: 523 $mm^2/s$, Flash point: 312° C.

*5Animal and vegetable fat and oil: Trade name: Rapeseed refined oil, Cosmo Oil Co., Ltd.

*6Organic molybdenum compound, MoDTC: Trade name: Adeka Sakura-Lube 165, Adeka Corporation (B-11) Test Condition 1-2

Table 2 shows test conditions used in the adhesion test and the release resistance test.

TABLE 2

| Item | Condition |
|---|---|
| Application amount (ml/s) | 2 |
| Application time (s) | 0.1 |
| Air pressure (MPa) | 0.2 |
| Metal die temperature (° C.) | 300, 400, 450 |

(C) Result of Test Measurement (C-1) High Temperature Residual Test

Table 3 shows test results of a heat loss ratio at a high temperature using the oil-based release agents shown in Table 1.

TABLE 3

| | | Example 1 | Comparative Example 1 |
|---|---|---|---|
| Heat loss ratio (%) | Heat balance temperature 100° C. | 1.4 | 1.8 |
| | Heat balance temperature 200° C. | 70.9 | 85.4 |
| | Heat balance temperature 300° C. | 78.2 | 87.3 |
| | Heat balance temperature 400° C. | 83.6 | 93.6 |
| | Heat balance temperature 450° C. | 85.9 | 95.5 |

The heat loss ratio at a heat balance temperature of 100° C. in Comparative Example 1 was 1.8%, and heat was hardly lost and remained as it was. However, when the heat balance temperature was 200° C., heat was lost rapidly, and the heat loss ratio in Comparative Example 1 was 85% or more.

In contrast, the heat loss ratio at a heat balance temperature of 200° C. in Example 1 was about 71%. That is, by blending the high temperature adhesive (b), it was possible to keep the heat loss ratio of a lubricating component low. As a result, it was possible to keep the remaining amount of the lubricating component.

The heat loss ratios at higher heat balance temperatures of 300° C., 400° C., and 450° C. in Example 1 were lower than those in Comparative Example 1. Therefore, it was possible to keep the remaining amount of the lubricating component high even at 300° C. or higher.

As a result, it was possible to make the remaining amount of the lubricating component at a heat balance temperature of 400° C. twice or more that of the sample which was a conventional oil-based release agent in Comparative Example 1.

(C-2) Adhesion and Release Resistance

Table 4 shows results of total evaluation of adhesion and release resistance in Example and Comparative Example.

TABLE 4

| | | Example 1 | Comparative Example 1 |
|---|---|---|---|
| Type of release agent | | Oil | Oil |
| Adhesion (mg) | Metal die temperature 300° C. | 5 | 3 |
| | Metal die temperature 400° C. | 4 | 3 |
| | Metal die temperature 450° C. | 4 | 2 |
| Release resistance (Kgf) | Metal die temperature 300° C. | 2.4 | 1.8 |
| | Metal die temperature 400° C. | 5.2 | 22.0 |
| | Metal die temperature 450° C. | 11.0 | 22.0 |
| Total evaluation | | Excellent | Unacceptable |

Adhesion and release resistance were evaluated totally. The best sample was evaluated as "excellent", followed by "good", "acceptable", and "unacceptable". The release agents in Table 1 were used, and an evaluation test was performed under test conditions in Table 2. Variation in an adhesion amount and a release resistance was generated. Therefore, each test was performed three times, and an average value thereof was used as a measured value.

Adhesion at metal die temperatures of 300° C., 400° C., and 450° C. in Table 4 was slightly larger in Example 1 than that in Comparative Example 1. However, adhesion in Example 1 and Comparative Example 1 had almost equivalent results. The release resistances at a metal die temperature of 300° C. in Example 1 and Comparative Example 1 had almost equivalent results similarly to adhesion.

A release resistance at a metal die temperature of 400° C. in Comparative Example 1 was 22.0 Kgf, and seizure occurred. Therefore, this was evaluated as "unacceptable" in the total evaluation. In Comparative Example 1, there was no difference in an adhesion amount between a metal die temperature of 300° C. and a metal die temperature of 400° C., but there was a difference in lubricity. It can be considered that lubricity is insufficient due to heat loss of the lubricating component by introduction of molten metal.

In contrast, a release resistance at a metal die temperature of 400° C. in Example 1 in Table 4 was 5.2 Kgf, and excellent lubricity was exhibited. Both adhesion and lubricity at a metal die temperature of 450° C. in Example 1 were maintained, and superiority of Example 1 could be confirmed. Lubricity (release resistance) at a metal die temperature of 300° C. in Example 1 was maintained at a level almost equivalent to that in Comparative Example 1. It was possible to confirm that stable lubricity could be secured even at a metal die temperature of about 300° C. As a result, this was evaluated as "excellent" in the total evaluation.

The sample in Example 1 can maintain a stable adhesion amount even with respect to a metal die at 400° C. or higher, and has stable lubricity. The high temperature adhesive (b) contained in the sample of Example 1 was not subjected to heat loss or thermal decomposition even at 450° C. It was possible to confirm that the high temperature adhesive (b) had stable lubricity even at a high temperature.

(D-1) Blending Concentrations of Low Volatile Conductive Modifier and Solubilizing Agent Table 5 shows results of total evaluation of blending concentrations of the low volatile conductive modifier (f) and the solubilizing agent (g) using Examples and Comparative Examples.

TABLE 5

| | Example 10 | Example 11 | Example 12 | Comparative Example 10 | Comparative Example 11 |
|---|---|---|---|---|---|
| Solvent*1 (mass %) | 99.9 | 99.5 | 98.1 | 98 | 98.6 |
| Low volatile conductive modifier*2 (mass %) | 0.1 | 0.5 | 0.4 | 2 | 0.4 |
| Solubilizing agent*3 (mass %) | 0 | 0 | 1.5 | 0 | 1.0 |
| Electric resistance | 300 | 190 | 360 | 2.5 | 450 |

TABLE 5-continued

| | Example 10 | Example 11 | Example 12 | Comparative Example 10 | Comparative Example 11 |
|---|---|---|---|---|---|
| (MΩ) | | | | | |
| Evaluation of electric resistance | Possible | Possible | Possible | Impossible | Impossible |
| Dispersibility | B | B | A | C | A |
| Total evaluation | Good | Good | Excellent | Unacceptable | Unacceptable |

*1Solvent: ISOPAR M (Petroleum-based saturated hydrocarbon solvent having 13 to 18 carbon atoms), Exxon Mobil Corporation, Flash point: 96° C.
*2Low volatile conductive modifier: Trade name: PIONIN C-159-ES (Imidazolium salt) Takemoto Oil & Fat Co., Ltd.
*3Solubilizing agent: Trade name: New Cargen 140 (Mixture of sorbitan type solubilizing agents) HLB value 6.96 (Estimated value), Takemoto Oil & Fat Co., Ltd.

An electric resistance and dispersibility were evaluated totally. The best sample was evaluated as "excellent", followed by "good", "acceptable", and "unacceptable".

In Table 5, samples not containing the solubilizing agent (g) in Examples 10 and 11 had slightly inferior dispersibility of B, but had electric resistances of 300 MΩ (Example 10) and 190 MΩ (Example 11) which were optimal electric resistances (3 to 400 MΩ), and were evaluated as "good" in the total evaluation. In contrast, a sample not containing the solubilizing agent (g) in Comparative Example 10 had an electric resistance of 2.5 which was lower than the optimal range of the electric resistance, had poor dispersibility of "C", and was evaluated as "unacceptable" in the total evaluation.

There is variation depending on the kind of the low volatile conductive modifier (f). However, an ionic liquid has high conductivity. Therefore, when a large amount of the ionic liquid is blended, the electric resistance may be outside a desired range of the electric resistance. Therefore, the content of the low volatile conductive modifier (f) is preferably from 0.1 to 5% by mass with respect to the total amount of the oil-based release agent. The content of the low volatile conductive modifier (f) is more preferably from 0.1 to 2% by mass.

As described above, samples in Examples 10 and 11 have slightly inferior dispersibility. Therefore, it is necessary to further enhance dispersibility for productization. A sample containing 1.0% by mass of the solubilizing agent (g) in Comparative Example 11 had excellent dispersibility of "A", but had a high electric resistance, and cannot obtain an electrostatic effect easily. Therefore, this was evaluated as "unacceptable" in the total evaluation. In contrast, a sample containing 1.5% by mass of the solubilizing agent (g) in Example 12 had an optimal electric resistance and excellent dispersibility. Therefore, this was evaluated as "excellent" in the total evaluation.

There are many kinds of the low volatile conductive modifiers (f) and many kinds of the solubilizing agents (g). An electric resistance changes largely depending on a combination thereof. When the low volatile conductive modifier (f) and the solubilizing agent (g) used in Examples are mixed to be used, the content of the solubilizing agent (g) is preferably more than 1% by mass and 15% by mass or less.

(D-2) Blending Concentration when Only Solubilizing Agent is Blended

Table 6 shows results of total evaluation of a blending concentration of the solubilizing agent (g) when only the solubilizing agent (g) is blended, using Example and Comparative Example.

TABLE 6

| | Example 20 | Comparative Example 20 |
|---|---|---|
| Solvent*1 (mass %) | 98 | 99 |
| Solubilizing agent*2 (mass %) | 2 | 1 |
| Electric resistance (MΩ) | 300 | 1050 |
| Evaluation of electric resistance | Possible | Impossible |
| Dispersibility | A | A |
| Total evaluation | Excellent | Unacceptable |

*1Solvent: ISOPAR M (Petroleum-based saturated hydrocarbon solvent having 13 to 18 carbon atoms), Exxon Mobil Corporation, Flash point: 96° C.
*2Solubilizing agent: Trade name: New Cargen 140 (Mixture of sorbitan type solubilizing agents) HLB value 6.96 (Estimated value), Takemoto Oil & Fat Co., Ltd.

An electric resistance and dispersibility were evaluated totally. The best sample was evaluated as "excellent", followed by "good", "acceptable", and "unacceptable".

In this test, a test was performed when the low volatile conductive modifier (f) was not contained but only the solubilizing agent (g) was contained. The solubilizing agent (g) contained a small amount of water. Therefore, an optimal electric resistance and improvement of dispersibility were aimed at while the content of the solubilizing agent (g) was reduced.

In Table 6, a sample containing 1% by mass of the solubilizing agent (g) in Comparative Example 20 was evaluated as "A" in dispersibility, but had an electric resistance of 1050 MΩ which was higher than an optimal range of the electric resistance, cannot obtain an electrostatic effect easily, and was evaluated as "unacceptable" in the total evaluation. In contrast, a sample containing 2% by mass of the solubilizing agent (g) in Example 20 had excellent dispersibility of "A" and an electric resistance of 300 MΩ in an optimal range of the electric resistance, and was evaluated as "excellent" in the total evaluation.

In general, blending of 5% by mass or more of the solubilizing agent (g) may lower the Leidenfrost temperature. Meanwhile, a combination with the sorbitan type solubilizing agent used in Examples can further reduce the content of the solubilizing agent. Therefore, the sorbitan type solubilizing agent is preferably blended at 0.3% by mass or more and less than 5% by mass with respect to the total amount of the oil-based release agent. The sorbitan type solubilizing agent is more preferably blended at 2% by mass or more and less than 5% by mass.

(D-3) Evaluation Test for LF Temperature (Leidenfrost Temperature), Adhesion, and Lubricity Table 7 shows results of total evaluation of a Leidenfrost temperature (hereinafter, referred to as LF temperature), adhesion, and lubricity using Examples and Comparative Example.

TABLE 7

| | Example 30 | Example 31 | Comparative Example 30 |
|---|---|---|---|
| Solvent*1 (mass %) | 84 | 77 | 54 |
| Low volatile conductive modifier*2 (mass %) | 0.4 | 0.4 | 0 |
| Water*3 (mass %) | 0 | 0 | 7.5 |
| Solubilizing agent*4 (mass %) | 1.6 | 1.6 | 30 |
| High temperature adhesive*5 (mass %) | 0 | 12 | 0 |
| Modified silicone oil*6 (mass %) | 6 | 0 | 3.6 |
| High viscosity mineral oil*7 (mass %) | 6 | 6 | 3.5 |
| Animal and vegetable fat and oil*8 (mass %) | 0.6 | 0.6 | 0.4 |
| Organic molybdenum compound*9 (mass %) | 0.6 | 0.6 | 0.4 |
| Flash point (° C.) | 98 | 101 | 115 |
| Kinematic viscosity (40° C.) (unit: $mm^2/s$) | 5.5 | 37.7 | 15.4 |
| LF temperature(° C.) | 410 | 470 | 340 |
| Adhesion amount (400° C.) (unit: mg) | 15.0 | 27.1 | 1.8 |
| Adhesion efficiency (%) | 44.9 | 55.3 | 2.0 |
| Lubricity (300° C.) (unit: kgf) | 3.8 | 5.1 | 5.5 |
| Lubricity (350° C.) (unit: kgf) | 9.8 | 4.7 | 20 |
| Lubricity (400° C.) (unit: kgf) | 20 | 6.7 | — |
| Lubricity (450° C.) (unit: kgf) | — | 9.2 | — |
| Total evaluation | Acceptable | Excellent | Unacceptable |

*1Solvent: ISOPAR M (Petroleum-based saturated hydrocarbon solvent having 13 to 18 carbon atoms), Exxon Mobil Corporation, Flash point: 96° C.
*2Low volatile conductive modifier: Trade name: PIONIN C-159-ES (Imidazolium salt), Takemoto Oil & Fat Co., Ltd.
*3Water: Tap water, Hardness 30
*4Solubilizing agent: Trade name: New Cargen 140 (Mixture of sorbitan type solubilizing agents) HLB value 6.96 (Estimated value), Takemoto Oil & Fat Co., Ltd.
*5High temperature adhesive: Trade name: Element14 PDMS 100K-J (In terms of molecular weight: 105757, Dimethyl polysiloxane having a kinematic viscosity of 100000 $mm^2/s$), Momentive Performance Materials Inc.
*6Modified silicone oil: Trade name: Release agent TN (In terms of molecular weight: 25243-31300, Alkylaralkyl modified polysiloxane having a kinematic viscosity of 900 to 1500 $mm^2/s$), Wacker Asahikasei Silicone Co., Ltd.
*7High viscosity mineral oil: Trade name: Super Oil N460, JX Nippon Oil & Energy Corporation Kinematic viscosity at 40° C.: 523 $mm^2/s$, Flash point: 312° C.
*8Animal and vegetable fat and oil: Trade name: Rapeseed refined oil, Cosmo Oil Co., Ltd.
*9Organic molybdenum compound: MoDTC, Trade name: Adeka Sakura-Lube 165, Adeka Corporation The LF temperature, adhesion, and a release resistance were evaluated totally. The best sample was evaluated as "excellent", followed by "good", "acceptable", and "unacceptable".

A sample in Comparative Example 30 in Table 7 was a conventional electrostatic application-type oil-based release agent. The sample contained much water. Therefore, the LF temperature in Comparative Example 30 was as low as 340° C., and an adhesion amount at 400° C. was reduced largely. The sample contained a large amount of the solubilizing agent (g) causing impediment of lubricity, and therefore the lubricity at 300° C. was 5.5 Kgf, lower than those in Examples 30 and 31. Therefore, in Table 7, the sample had lubricity of 20 kgf at a metal die temperature of 350° C. in Comparative Example 30, and caused seizure. The sample in Comparative Example 30 was evaluated as "unacceptable" in the total evaluation because high temperature adhesion and high temperature lubricity were low.

In contrast, a sample containing no water and having a content of the solubilizing agent (g) as low as possible in Example 30 maintained the LF temperature at 400° C. or higher and had a stable adhesion amount of 15 mg at 400° C. The lubricity at 350° C. was 9.8 kgf, and had lubricity. Therefore, the sample in Comparative Example 30 was evaluated as "acceptable" in the total evaluation.

The low volatile conductive modifier (f) contained in the sample of Example 30 has high conductivity. Therefore, addition of only a small amount thereof makes it possible to obtain an optimal electric resistance. In addition, it is possible to make the content of water lowering the LF temperature or the solubilizing agent (g) causing impediment of lubricity zero or small. The low volatile conductive modifier (f) has high thermal stability, and hardly evaporates even at a high temperature. Therefore, the high temperature heat resistance thereof can be higher than that of water or an organic solvent. These tests have revealed that the adhesion efficiency is improved largely and the high temperature adhesion and the high temperature lubricity are enhanced only by switching water and the solubilizing agent (g) as a conventional electrostatic application technology to the low volatile conductive modifier (f).

A sample containing both the low volatile conductive modifier (f) according to the second embodiment and the high temperature adhesive (b) according to the first embodiment in Example 31 had an adhesion amount of 27.1 mg almost twice that in Example 30, and maintained 9.2 Kgf of lubricity even with respect to a metal die at 450° C. Therefore, the sample in Example 31 was evaluated as "excellent" in the total evaluation.

The high temperature adhesive (b) contained in the sample of Example 31 can suppress heat loss or thermal decomposition at a high temperature like a conventional lubricating component. Therefore, adhesion with respect to a metal die at 400° C. was improved largely. As indicated by Example 31, it has been possible to confirm that lubricity with respect to a metal die at 450° C. is maintained.

As described above, by blending the low volatile conductive modifier (f) and the high temperature adhesive (b) together, adhesion with respect to a metal die at a high temperature is improved largely, and lubricity at a high temperature is also stable. Therefore, the high temperature adhesive (b) according to the first embodiment and the low volatile conductive modifier (f) according to the second embodiment can be blended together. High temperature adhesion and stable lubricity can be obtained due to the high temperature adhesive (b). Furthermore, an electrostatic effect is obtained, and an adhesion amount can be increased due to the low volatile conductive modifier (f).

(E-1) Evaluation with Real Machine: Polishing Lifetime Test

Table 8 shows results of total evaluation by comparison between Example and Comparative Example for a polishing lifetime test with a real machine.

TABLE 8

| | Example 40*1 | Comparative Example 40*2 |
|---|---|---|
| Observation point 1 (Unit: Shot) | 230 | 120 |
| Evaluation | Low frequency | High frequency |
| Observation point 2 (Unit: Shot) | 250 | 150 |
| Evaluation | Low frequency | High frequency |
| Observation point 3 (Unit: Shot) | 750 | 200 |
| Evaluation | None | Low frequency |
| Total evaluation | Excellent | Unacceptable |

*1The same release agent as that in Example 1 shown in Table 1 was used.
*2The same release agent as that in Comparative Example 1 shown in Table 1 was used.

A sample requiring polishing in 150 shots or less was evaluated as "high frequency". A sample requiring polishing in 250 shots or less was evaluated as "low frequency". A sample requiring no polishing even in 250 shots or more to perform periodic inspection was evaluated as "none".

Polishing lifetime was evaluated totally. The best sample was evaluated as "excellent", followed by "good", "acceptable", and "unacceptable".

At observation points 1 and 2 in a sample which was a conventional oil-based release agent in Comparative Example 40, polishing was required in 150 shots or less to be evaluated as "high frequency". At an observation point 3, the shot was more than 150 shots but less than 250 shots to be evaluated as "low frequency". Therefore, the sample in Comparative Example 40 causes seizure easily in a metal die at a high temperature, and therefore was evaluated as "unacceptable" in the total evaluation.

In contrast, the sample containing the high temperature adhesive (b) according to the first embodiment in Example 40 had a result of 250 shots or less at observation points 1 and 2, and was evaluated as "low frequency" in polishing lifetime evaluation. At the observation point 3, polishing was not required before 750 shots were performed. Therefore, this was evaluated as "none" in polishing lifetime evaluation. Therefore, the sample in Example 40 can suppress occurrence of seizure in a metal die at a high temperature, and therefore was evaluated as "excellent" in the total evaluation.

As indicated in Comparative Example 1 of Table 1, the sample in Comparative Example 40 contains a modified silicone oil, and another additive such as a high viscosity mineral oil or animal and vegetable fat and oil. Nevertheless, total evaluation of polishing lifetime in Comparative Example 40 was unacceptable. That is, it can be said that adhesion or lubricity with respect to a metal die at a high temperature of 300 to 400° C. is insufficient even by blending a modified silicone oil not reaching a desired molecular weight and another additive together.

In contrast, as indicated in Example 1 of Table 1, the sample in Example 40 contains both the high temperature adhesive (b) and another additive. Adhesion or lubricity in a metal die at a high temperature is thereby maintained at a high level. As a result, this was evaluated as "excellent" in the total evaluation of polishing lifetime with a real machine. It can be expected that high adhesion or high lubricity is maintained even with respect to a metal die at about 450° C.

If occurrence of seizure can be suppressed, casting can be performed continuously for a longer time than related art. Therefore, a manufacturing efficiency is improved largely.

Large-scaled occurrence of seizure causes a defect of a product or the like. Therefore, it is necessary to perform polishing suddenly. The oil-based release agent according to the first embodiment made it possible to reduce a stopping ratio of equipment caused by sudden polishing by 50% or more as compared with a conventional oil-based release agent By using the oil-based release agent according to the present invention, the Leidenfrost temperature can be 300° C. or higher. Therefore, the oil-based release agent can adhere to a metal die even when the temperature of the metal die is 300° C. or higher. In addition, the oil-based release agent has high adhesion with respect to a metal die at a high temperature of 300° C. or higher, has low surface tension, and can extend a coating film thinly. Therefore, the oil-based release agent can reduce an application amount to a metal die as compared with a water-soluble release agent.

The oil-based release agent according to the present invention contains the high temperature adhesive (b), and can thereby maintain stable lubricity even with respect to a metal die at 300° C. or higher, and can maintain desired lubricity.

By adjusting a content of an additive other than the high temperature adhesive (b) in the oil-based release agent according to the present invention, it is possible to enlarge a range of an application temperature, improve a coating film strength, further raise the Leidenfrost temperature, and the like. A stable adhesion amount and lubricity corresponding to a wide temperature range can be thereby maintained even with respect to a metal die at 400° C. or higher.

Furthermore, the oil-based release agent according to the present invention contains no water causing impediment of high temperature adhesion, and can be adjusted so as to have an optimal electric resistance for electrostatic application. Therefore, electrostatic application with heat resistance can be performed. This electrostatic effect can further enhance adhesion.

INDUSTRIAL APPLICABILITY

The present invention provides an oil-based release agent adhering to a metal die at a high temperature of 300° C. or higher even with application in a small amount and having stable lubricating performance with respect to the metal die at a high temperature while a working environment is considered and lifetime of the metal die is improved. In addition, the present invention provides a method for applying an oil-based release agent, capable of reducing accumulation of a lubricating component.

REFERENCE SIGNS LIST

10: adhesion tester
11: temperature controller
12: heater
13: housing
14: support bracket
15: test piece
16: temperature sensor (thermocouple)
17: release agent
18: spraying apparatus
20: automatic tensile tester
21: test plate
22: temperature sensor (thermocouple)
23: spraying apparatus
24: tester frame
25: ring
26: molten aluminum
27: weight

The invention claimed is:

1. An oil-based release agent comprising
a petroleum-based hydrocarbon solvent (a),
an adhesive (b), wherein adhesive (b) is dimethyl polysiloxane having a weight average molecular weight of 100,000 or more, and
a conductive modifier (f), wherein the conductive modifier (f) is at least one selected from the group consisting of
an imidazolium salt (f-1),
a pyrrolidinium salt (f-2),
a pyridinium salt (f-3),
a phosphonium salt (f-5), and
a sulfonium salt (f-6);
wherein the release agent contains 0% water.

2. The oil-based release agent according to claim 1, wherein the petroleum-based hydrocarbon solvent (a) is at least one selected from the group consisting of a paraffinic hydrocarbon solvent, an olefinic hydrocarbon solvent, a naphthenic hydrocarbon solvent, and an aromatic hydrocarbon solvent.

3. The oil-based release agent according to claim 1, further comprising a lubricating additive (c) containing at least one selected from the group consisting of a mineral oil (c-1), animal and vegetable fat and oil and a fatty acid ester (c-2), an organic molybdenum compound (c-3), and an oil-soluble soap (c-4).

4. An electrostatic-spraying oil-based release agent comprising a petroleum-based hydrocarbon solvent (a) and a conductive modifier (f), wherein the conductive modifier (f) is at least one selected from the group consisting of an imidazolium salt (f-1), a pyrrolidinium salt (f-2), a pyridinium salt (f-3), a phosphonium salt (f-5), and a sulfonium salt (f-6);

wherein the electric resistance is 3 to 400 MΩ.

5. The electrostatic-spraying oil-based release agent according to claim 4, further comprising a lubricating additive (c) containing at least one selected from the group consisting of a mineral oil (c-1), animal and vegetable fat and oil and a fatty acid ester (c-2), an organic molybdenum compound (c-3), and an oil-soluble soap (c-4).

6. A method for applying an oil-based release agent, comprising applying the oil-based release agent according to claim 1 to a metal die at a particle speed of 2 to 50 m/s so as to have a mist diameter of 0.1 to 60 μm.

7. A method for electrostatically applying an electrostatic-spraying oil-based release agent, comprising applying the electrostatic-spraying oil-based release agent according to claim 4 to a metal die.

* * * * *